US008177690B2

(12) United States Patent
Wierszewski

(10) Patent No.: US 8,177,690 B2
(45) Date of Patent: May 15, 2012

(54) THERAPEUTIC HAND EXERCISE DEVICE

(76) Inventor: Norbert T. Wierszewski, Dearborn, MI (US)

( * ) Notice: Subject to any disclaimer, the term of this patent is extended or adjusted under 35 U.S.C. 154(b) by 114 days.

(21) Appl. No.: 12/783,221

(22) Filed: May 19, 2010

(65) Prior Publication Data

US 2010/0298099 A1 Nov. 25, 2010

Related U.S. Application Data

(60) Provisional application No. 61/180,149, filed on May 21, 2009.

(51) Int. Cl.
*A63B 21/00* (2006.01)

(52) U.S. Cl. ..... 482/44; 482/49

(58) Field of Classification Search ..... 482/44, 482/49; 473/355, 375
See application file for complete search history.

(56) References Cited

U.S. PATENT DOCUMENTS

| | | | | |
|---|---|---|---|---|
| 4,984,784 | A | 1/1991 | Bailey | |
| 5,580,336 | A | 12/1996 | Coallier | |
| 6,217,504 | B1 | 4/2001 | Phillips | |
| 6,656,108 | B1 | 12/2003 | Spalding, Jr. et al. | |
| 6,991,561 | B2 * | 1/2006 | Nesbitt et al. | 473/355 |

OTHER PUBLICATIONS

Sorenson, John R.J., Theraputic Copper, perunaturex partners, May 4, 2010, 1-3.

* cited by examiner

*Primary Examiner* — Jerome W Donnelly
(74) *Attorney, Agent, or Firm* — Gifford, Krass, Sprinkle, Anderson & Citkowski, P.C.

(57) ABSTRACT

A handheld exercise device in the form a single nonresilient ball, or a pair of balls, which have a copper surface and have internal permanent magnets embedded within the balls which generate magnetic fields around the outer surface of the ball. The balls may be grasped in the palm of a hand and manipulated so as to combine the therapeutic effects of exercise, copper absorption into the skin, and magnetic field therapy.

6 Claims, 3 Drawing Sheets

THERAPEUTIC HAND EXERCISE DEVICE

CROSS-REFERENCE TO RELATED APPLICATIONS

This application claims priority of U.S. Provisional Patent Application Ser. No. 61/180,149 filed May 21, 2009, which is incorporated herein by reference.

FIELD OF THE INVENTION

This invention relates to a handheld exercise device in the form of a ball having a copper surface and internal permanent magnets formed within the surface of the ball so as to generate magnetic fields around the outer surface of the ball. The balls may be grasped in the palm of a hand and manipulated so as to combine the therapeutic effects of exercise, copper absorption into the skin, and magnetic field therapy.

BACKGROUND OF THE INVENTION

The hand manipulation of balls is well known as an exercise activity and also to calm the nerves. Rubber balls are often sold for that purpose, or solid balls like the ball bearings that the character Caption Queeg habitually manipulated in The Cain Mutiny may be employed.

Additionally, the exposure of body parts to magnetic fields has long been used to relieve arthritis-like pain. Magnetic straps for wrists, ankles, and the back as well as shoe insoles and magnetic blankets enjoy substantial sales. Medical studies have established therapeutic value for exposure of body parts to magnetic fields, usually attributed to the relative movement and resulting interaction between the blood flowing in the body, which is weakly conductive of electric currents, and the magnetic fields with the two interacting to generate heat and the like.

Separately, copper articles which are supported against the skin are recognized to create compounds which are absorbed into the skin and provide the numerous therapeutic benefits known to be produced by copper trace elements in the body.

SUMMARY OF THE INVENTION

The present invention is accordingly directed at a ball like, substantially spherical device adapted to fit within the palm of a hand and when squeezed or otherwise manipulated to simultaneously provide the therapeutic benefits of hand exercise, magnetic therapy, and copper therapy. The device constitutes a substantially nonresilient ball which may be solid or hollow. The ball volume is preferably formed with a diamagnetic material which may be copper, certain plastics, or the like. The interior volume of the ball also supports permanent magnets which may be in the form of bars, segments, particulate matter, or any combination of these. These ferromagnetic sources are disposed within the outer surface of the ball to generate magnetic fields which extend over the exterior surface of the ball so that when the ball is held in the palm of a hand the magnetic lines of force intersect and cooperate with the body tissues of the hand.

A variety of configurations of permanent magnets supported within the balls are useful to generate the external magnetic fields required by the present invention. In one preferred embodiment, which will subsequently be disclosed in detail, the magnets are in the form of elongated bars which may be of any cross section, having their two ends both substantially flush with separated points on the surface of the ball so that the magnetic field generated by each of these elongated magnets extends at least partially along the outer surface of the ball. In other embodiments, a paramagnetic compound such as ferric oxide mixed with a plastic binder and passed through magnetic fields so as to impress the low permeability plastic sheet with magnetic poles in alternating line format may be employed. This creates alternating north and south poles on the paramagnetic compound which may be oriented closely to the surface of the ball so as to generate magnetic fields which extend externally to the ball.

The ferromagnetic materials used to form the magnets embedded within the ball include iron, nickel, cobalt, rare earth metals, and various alloys such as alnico.

Some relatively expensive ferromagnetic materials capable of producing strong magnetic fields may be combined with weaker ferromagnetic materials such as iron, to produce relatively large yet economical structures which will project their magnetic fields externally of the ball.

The preferred embodiment of the present invention incorporates a copper surface which may be in the form of a solid copper ball having voids for receipt of the permanent magnets necessary to create the external field, or by copper coating or plating the exterior surface of a ball having a paramagnetic interior embedded with ferromagnetic permanent magnets.

The balls of the present invention may be used either singly or in pairs to provide the desired exercise and therapeutic properties. The balls may have a diameter between about ¾ and 4 inches but preferably range from 1 to 3 inches in diameter. The larger balls may have sufficient weight to provide weightlifting benefits to the upper arms and shoulders.

BRIEF DESCRIPTION OF THE DRAWINGS

Other objects, advantages, and applications of the present invention will be made apparent by the following detailed description of several preferred embodiments of the invention. The description makes reference to the accompany drawings in which.

DETAILED DESCRIPTION OF THE PREFERRED EMBODIMENTS

Figure 1:
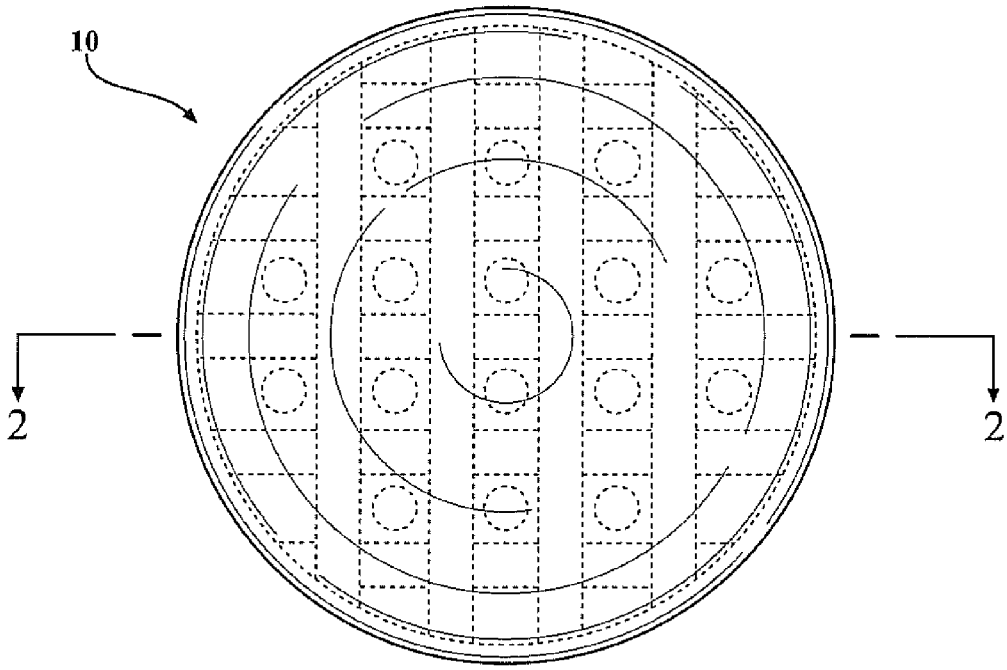
FIG. 1 is a side view of a therapeutic exercise ball formed in accordance with the present invention.
Figure 2:
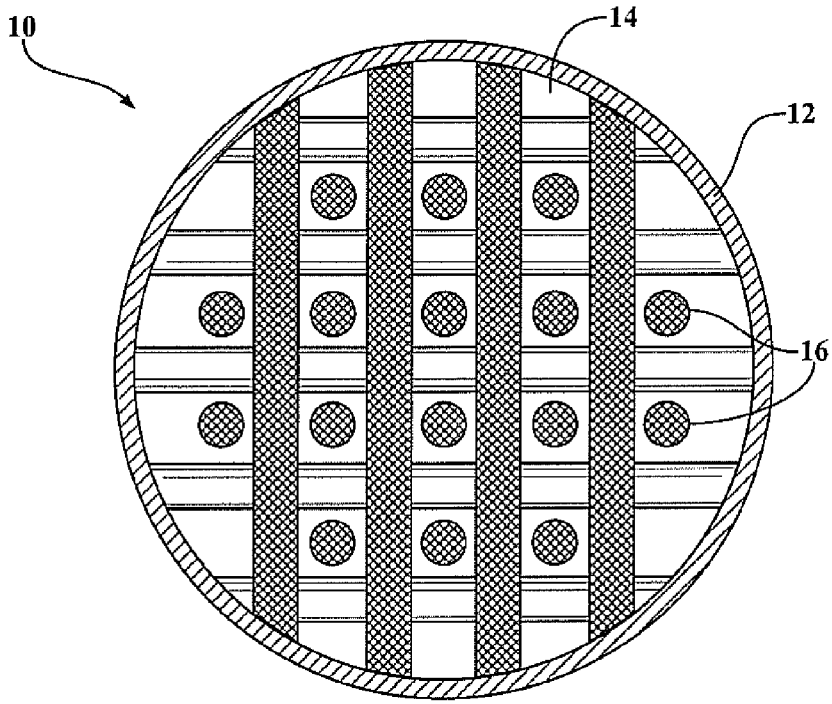
FIG. 2 is a cross-sectional view through the ball of FIG. 1 taken along lines 2-2 of FIG. 1.

Referring to the drawings, and FIGS. 1 and 2 in particular, a first preferred embodiment of the invention comprises a substantially spherical ball, generally indicated at 10. The ball is formed essentially of a nonmagnetic material which might, for example, comprise copper, aluminum, or any of a wide variety of plastics. The material used in the ball is sufficiently rigid that the ball cannot be compressed by application of manual forces.

If the ball is formed of a nonmagnetic material other than copper, it will have a copper coating 12 on its outer surface.

This coating could be made by any known technique such as plating or application of various powdered forms of copper.

The ball 10 has a number of elongated bar magnets 16 embedded in its volume. The magnets 16 each have both of their ends terminating at or near the surface of the ball 10 at spaced points. The ball 10 includes the magnets 16 formed in a grid pattern, with certain of the bar magnets extending parallel and spaced from one another and other of the magnets extending parallel and spaced from one another at an angle to the first group.

Figure 5:
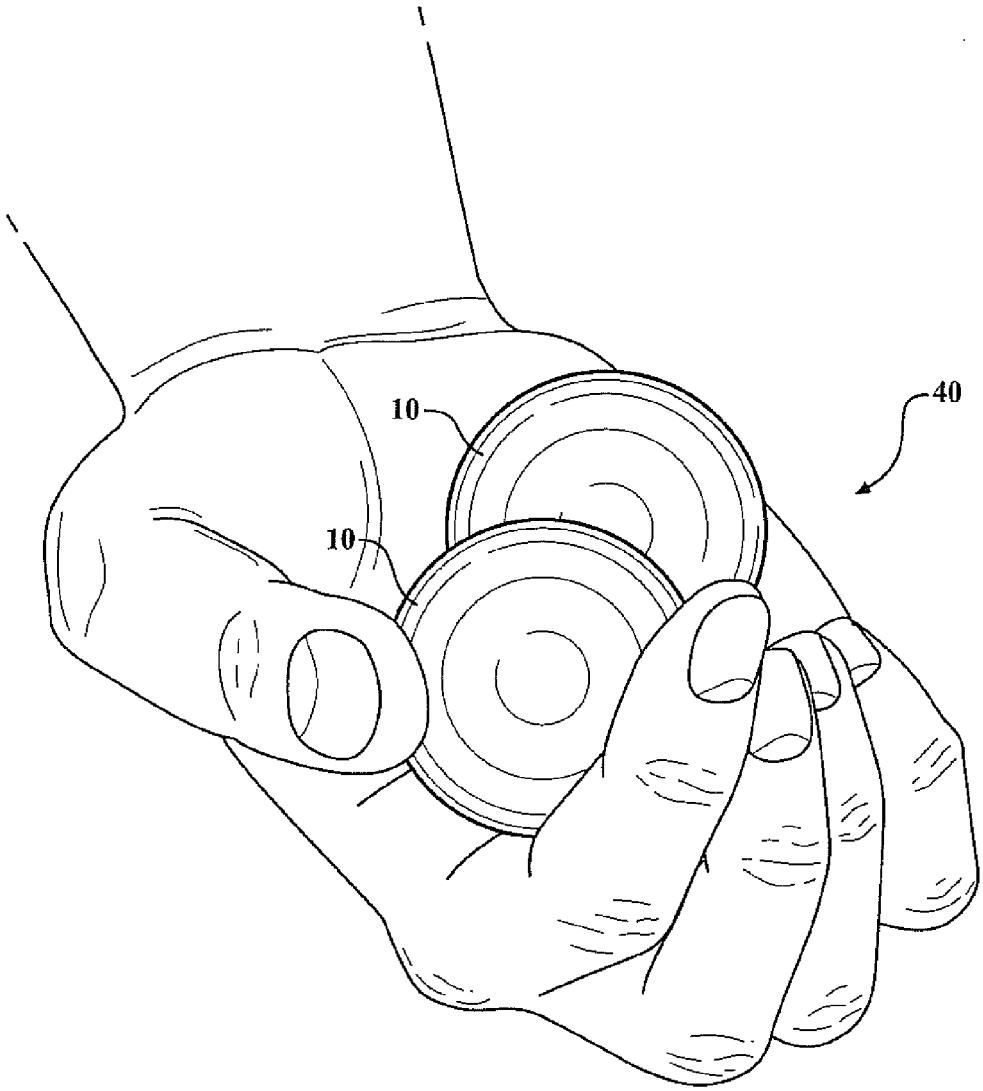
FIG. 5 is a perspective view of a pair of balls formed in accordance with the present invention, being held for manipulation within a hand.

As has been noted, the ball 10 may range in diameter from about between ¾ of an inch to about 4 inches and preferably has a diameter of between about 1 and 3 inches. This allows two of the balls to be held in the palm of an adult hand and manipulated by the hand to provide exercise as illustrated in FIG. 5. During manipulation the contact between the skin of the hand and the copper surface 12 of the ball 10 provides the therapeutic benefits of copper which enter the body through the skin primarily in the form of ionic compounds. These compounds are believed to alleviate arthritic and rheumatoid arthritic pains and also ensure that the body has a sufficient input of copper which is a critical micronutrient.

Simultaneously, the manipulation of the balls moves the hand through the magnetic fields that are generated between the ends of the bar magnets 16. The alignment of the magnets 16 with respect to the surface of the ball assures maximum flux density over the exterior surface of the ball. The interaction of that magnetic flux with blood flowing through the body is believed to have a substantial therapeutic effect.

The magnets 16 may be formed of a magnetized ferromagnetic material along their entire length or may alternately incorporate ferromagnetic sources such as relatively expensive ferrite magnets, with the balance of the length of the magnet 16 constituting a lower cost ferromagnetic material such as iron.

Various composite materials such as ceramic or ferrite magnets made of sintered composite of powdered iron oxide and barium/strontium carbonate ceramic may be used for the magnets 16 or for sections of the magnets combined with other ferromagnetic materials.

The magnetic fields will be generated between the north and south poles of the bar magnets 16 and will thus envelope the major portion of the exterior of the ball 10.

Figure 3:
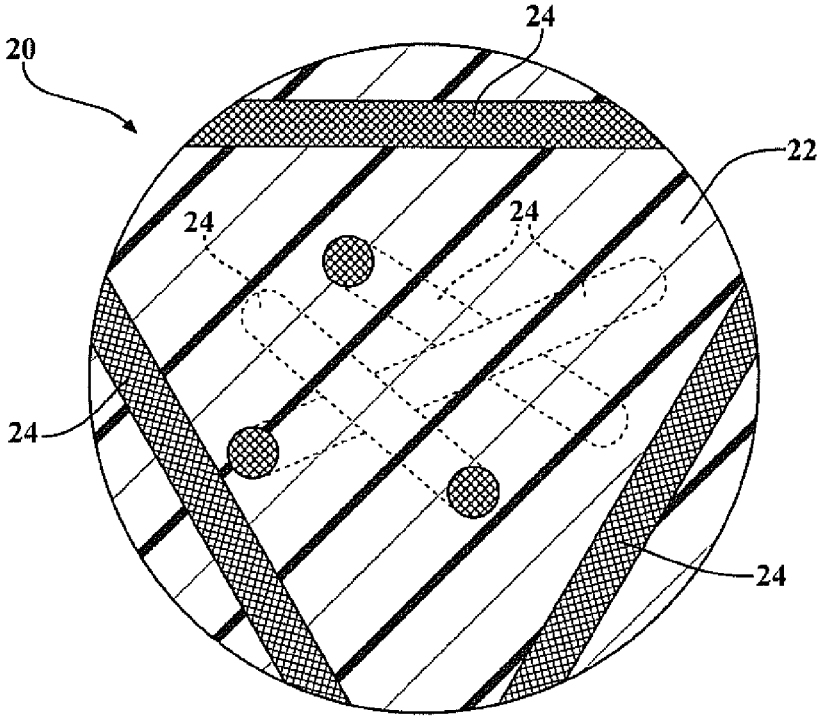
FIG. 3 is a cross-sectional view through an alternative embodiment of the invention employing a plurality of internal bar magnets spaced as chords of sections of the circumference of the balls.

There are an infinite variety of arrangements for positioning ferromagnets within the balls of the present invention to generate magnetic fields extending over the surface of the ball. A ball 20 illustrated in cross section in FIG. 3 is formed of a nonmagnetic material 22 which supports a plurality of elongated bar magnets 24 which are positioned beneath the surface of the ball 20 with each of their ends terminating adjacent to spaced points on the surface of the ball. Similar arrays of magnets 24 would be disposed within the ball at other cross sections. Again, the ball 20 could be formed of copper or alternatively have a copper covered surface.

Figure 4:
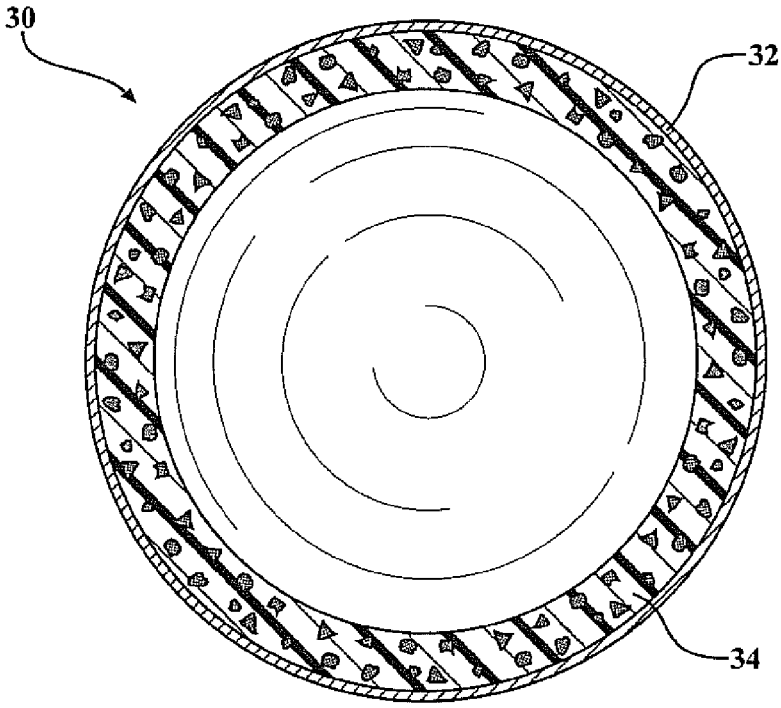
FIG. 4 is a cross section through another embodiment of the invention employing permanent magnets in the form of small magnetic particles disposed in a binding matrix which may be resilient.

FIG. 4 illustrates a cross section of another embodiment of the invention comprising a ball 30 formed of a nonmagnetic material. The ball again has a copper surface 32 and beneath the surface a layer 34 which incorporates small magnetic particles embedded in a paramagnetic matrix surface. The layer 34 could be formed of ferric oxide particles mixed with a plastic binder and then extruded into a sheet with the particles imbued with permanent magnetism by exposing them to a strong magnetic field. The field is preferably arranged so as to create magnetic poles in an alternating line format through the material 34. In this arrangement, the copper outer layer 32 is preferably formed by electroplating or the like.

FIG. 5 illustrates the manner of use of a pair of balls 10 by holding them in the palm of a user's hand 40 and manipulating them to exercise the hand, expose it to the magnetic field surrounding the ball, and bringing the copper coating of the ball into contact with the skin to impart the advantages of copper filtration through the skin.

Having thus described my invention, I claim:

1. A therapeutic exercise device in the form of a spherical ball of a size adapted to be manipulated within one hand of a user, having a copper surface having a number of permanent magnets disposed in the ball at spaced points so as to create a magnetic flux pattern over the surface of the ball, and the volume of the ball, with the exception of the permanent magnets, is formed of a nonmagnetic material other than copper.

2. The exercise device of claim 1 wherein each of said permanent magnets is elongated, having two ends, and is disposed within the ball so that each of the ends is adjacent to spaced points on the surface of the ball.

3. The exercise device of claim 1 wherein the entire volume of the ball, excluding the permanent magnets, is copper.

4. The exercise device of claim 1 wherein the copper surface is formed by electroplating.

5. A therapeutic exercise device for a hand comprising a spherical ball substantially nonresilient, having a number of permanent bar magnets embedded within its surface with the ends of each magnet disposed adjacent to space points on the surface of the ball to create a magnetic field extending exterior of the ball disposed within a nonmagnetic volume and having a copper surface.

6. The exercise device of claim 5 having a diameter of between ¾and 4 inches.

* * * * *